United States Patent [19]

Rahmfeld

[11] 4,452,298

[45] Jun. 5, 1984

[54] METHOD AND APPARATUS FOR COOLING CONTINUOUSLY CAST METAL STRANDS

[75] Inventor: Werner Rahmfeld, Mulheim, Fed. Rep. of Germany

[73] Assignee: Mannesmann Aktiengesellschaft, Dusseldorf, Fed. Rep. of Germany

[21] Appl. No.: 361,126

[22] Filed: Mar. 23, 1982

[30] Foreign Application Priority Data

Mar. 31, 1981 [DE] Fed. Rep. of Germany ..... 3112673

[51] Int. Cl.[3] ..... B22D 11/12; B22D 11/124

[52] U.S. Cl. ..... 164/485; 164/443; 164/448

[58] Field of Search ..... 164/441, 442, 447, 448, 164/484, 485, 486, 443, 444

[56] References Cited

U.S. PATENT DOCUMENTS 3,229,759 1/1966 Grover .
4,090,553 5/1978 Beghin ..... 164/448
4,197,900 4/1980 Bloshenko et al. ..... 164/514 X

FOREIGN PATENT DOCUMENTS 913697 6/1954 Fed. Rep. of Germany .
1264461 3/1968 Fed. Rep. of Germany .

OTHER PUBLICATIONS

Manual of Strand Casting 1958, 188.

*Primary Examiner*—Kuang Y. Lin
*Attorney, Agent, or Firm*—Mandeville and Schweitzer

[57] ABSTRACT

A method and apparatus for the cooling of a continuously cast metal strand, comprising a plurality of support rollers, located in the second zone of cooling. The support rollers are cooled from their interior by the passage therethrough of cooling fluid. The rollers have interior walls which display a wave-like shape to present a great surface area for superior cooling while still supporting the loading stress due to the weight of the metallic strand.

9 Claims, 5 Drawing Figures

METHOD AND APPARATUS FOR COOLING CONTINUOUSLY CAST METAL STRANDS

BACKGROUND OF THE INVENTION AND DESCRIPTION OF THE PRIOR ART

The present invention relates to a method for cooling continuously cast-steel strands. In addition, the present invention relates to a cooling apparatus capable of carrying out the method disclosed herein.

Continuously cast-steel strands have been traditionally cooled in a spray-water cooling process, in which, essentially, the heat required for vaporization of the cooling water is absorbed, to thereby carry away the heat of the metallic cast strand. In the spray-water cooling process, the cooling water does not only extract the heat from the hot cast strand but, in addition, simultaneously protects the support elements (rollers) and other structural elements of the continuous-casting apparatus against undesirable overheating (Manual of Strand Casting 1958, 188, by Dr. Hermann).

From DE-B2-913 697 it is known to use internally cooled rollers in continuous rubber casting. Rubber casting, however, is significantly and completely different in various aspects from continuous steel casting. One of these essential differences lies in the fact that, in the processing of rubber, heat must first be added to the strand and the temperature then downwardly adjusted by cooling.

SUMMARY OF THE INVENTION

The basic object of the present invention is to reduce the temperature of the metallic casting strand, in a dry procedure, using internally cooled roller elements and to thereby completely bypass the conventional water spray cooling process.

The solution, according to the invention, is that the heat of the continuously cast metal strand is eliminated exclusively through structural metal roller elements, which are cooled from the inside. The cooling occurs, by location of the hollow rollers, on the metallic cast strand in the lower cooling section or secondary cooling zone, as defined in the Detailed Description of the Drawings. The structural roller elements surround, support and guide the cast strand during cooling. During the cooling process the cooling fluid, preferably in the form of liquid, is circulated and itself cooled. The invention substantially avoids the disadvantages of the water spray cooling process, namely non-uniform cooling of the strand surface, disproportionately high thermal stress in areas of the strand, undercooling of the edges, uncontrollable quantities of cooling water on the strand surface, an otherwise required preparation of water spray, an otherwise large clearance for the strand support because the water spray jets are arranged between adjacent support elements, the stress due to thermal shock on the support roller elements themselves and distortion of the support elements because of the heat generated by the process.

One basic advantage of the present invention is the provision of uniform cooling of the surface of the cast strand so that thermal stress may be kept low in critical areas of the cast strand. Also, by eliminating the water spray jets, the spacing of adjacent support roller elements may be kept smaller so that the undesirable bulges of the cast strand, which otherwise occur due to the, not as yet, sufficiently solidified inside, are avoided.

The present invention is also based on the cooling circulation process, in which the cooling fluid, preferably a liquid, circulates within the structural roller elements, absorbs heat, and is close-circuit subsequently cooled by having the now-heated fluid pass outside of the structural roller elements.

One of the problems with the mentioned cooling apparatus of the present invention lies in the difficulty of providing a high-heat flow, i.e., good heat transfer through the wall of the hollow structural roller elements. It is desirable that a large amount of the heat of the cast strand be withdrawn from the strand. This presupposes a low heat resistance of the wall of the structural roller element. In attempting to solve this problem, the wall of the structural element could be very thinly made (thereby decreasing heat wall resistance and increasing heat flow through the wall) which, however, is contrary to the customary principles of high mechanical stress capacity of the structural roller elements. Where support rollers of extended length, for example, are used, thin walls of structural roller elements cannot be used because they could not withstand the otherwise present stress of the cast strand.

The present invention, therefore, operates without a too-thin structural roller wall thickness and, nevertheless, a low heat resistance value for the wall is obtained, i.e., a high heat-transfer performance is provided.

The present invention solves the dilemma of wall thickness being thin for high heat transfer and wall thickness being thick for support of the strand, by providing recesses in the interior wall of the structural roller element which recesses face the cast strand. Thus, the heat flow resistance of the roller walls, in its inner surface, is kept to a minimum without sacrificing structural rigidity. The inner wall surfaces of the rollers consist of a plurality of grooves or recesses of a width and depth of less than one millimeter.

The cooling process of the present invention, according to the invention, may alternatively also be carried out with a cooling apparatus designed such that the inner wall surface of the structural roller element consists of a capillary-type structure similar to that used in heat transfer pipes.

The cooling apparatus, according to the invention, has a structural roller element consisting of a support roller which is rotatably supported on a hollow journal pin for feeding in and allowing for outflow of cooling fluid, preferably liquid. Alternatively, vaporous cooling fluid can be used. Between adjacent support rollers, a distance of between three and five millimeters is preferably maintained. The hollow support rollers allow for substantial uniform cooling of the metallic cast strands. Furthermore, the support rollers, themselves, are cooled without the mentioned disadvantages of the water spray cooling mechanism.

A high density heat flow and a simultaneous high mechanical stress capacity is obtained when the recesses in the interior wall of the structural roller element extend in a quasi wave-like manner along the longitudinal cross section. Located within the wave-like cross section are capillary-type structures. The recesses advantageously reinforce the flow of heat from the cooling metallic cast strand through the structural roller element wall.

A complete cooling system for a section of the support roller frame of a continuous-casting metallurgical mill can be provided by having a plurality of the interior cooled support rollers connected, through their hollow draining bearing pins, to a cooling device at a heat-emitting area, and the hollow infeed bearing pins of the roller elements connected to a different cooling device.

A closed circuit cooling loop substantially corresponding to the structure of the continuous-casting apparatus can also be designed such that the first cooling device extends basically parallel to the cast strand.

The conventional method for cooling cast-steel strands works according to the water spray cooling process, in which the heat vaporizing the cooling water on the surface of the hot cast strand, is used to cool the strand. The conventional method necessitates a minimum distance for location of the spray jets between the support rollers. However, in order to avoid non-uniform cooling of the strand surface, high thermal stress in the strand, undercooling of the strand's edges, uncontrollable quantities of cooling water on the strand surface, as well as an otherwise required water spray preparation, in which the spray water, besides, causes stresses by thermal shock on the roller support elements and heat distortion of the roller support elements, it is suggested, in the present invention, that the heat be eliminated from the cast strand, in the secondary cooling zone of the casting guide, exclusively through structural metal roller elements, which are cooled from the inside. The roller elements surround the cast strand at short adjacent distances between rollers and support and guide the strand, while the cooling fluid circulates within the rollers.

The cooling apparatus required in order to carry out the cooling process is designed in such a manner that the structural roller element interior walls have recesses in their inner surfaces. This results in the decreasing of the heat resistance of the wall. The inner surface can be provided with a plurality of grooves or recesses of a width and depth smaller than one millimeter. It is furthermore proposed that the inner surface of the structural roller element wall have a fin-like structure which is similar to the structure used in heat transfer pipes.

An exemplary embodiment of the invention is illustrated in the drawings and is explained in further detail as follows:

DETAILED DESCRIPTION OF THE DRAWINGS

Figure 1:
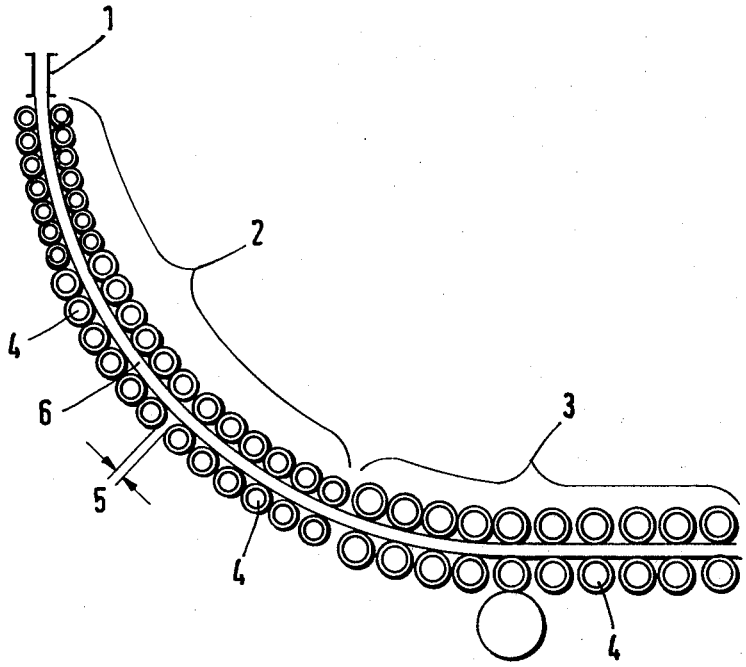
FIG. 1 is a schematic side elevational view of a continuous-casting apparatus.

The continuous-casting apparatus shown in FIG. 1 displays a continuous-casting cast-iron mold 1 and a strand guide comprising an upper cooling roller section 2 and a lower cooling roller section or secondary cooling zone 3. The individual support rollers 4 are separated by a distance 5 which, according to the invention, is set at approximately three to five millimeters.

The structural roller elements, according to the invention, are formed by the support rollers 4. These structural roller elements surround the metallic cast strand 6 at a gap clearance which does not interfere with the movement of the cast strand 6, i.e., the support rollers 4 support and guide the cast strand 6 by being in direct contact therewith but do not inhibit the controlled movement of the cast strand 6.

The exemplary embodiment of the present invention, as shown in FIG. 1, does not, therefore, require the conventional water spray cooling system (not illustrated). The disadvantages of the conventional water spray cooling process were previously explained, in brief detail, In brief review, however, the cooling water emanating from the conventional spray jets can and do cause the metallic cast strand surface to cool non-uniformly, in which disproportionately high thermal stress cracks or other defects may form in the strand. Also, undercooling of the edges may result from water spray. In addition, conventional water spray techniques may require a water spray preparation procedure. The conventional spray cooling process, furthermore, causes thermal shock stress and heat distortion on the support elements, themselves.

Figure 2:
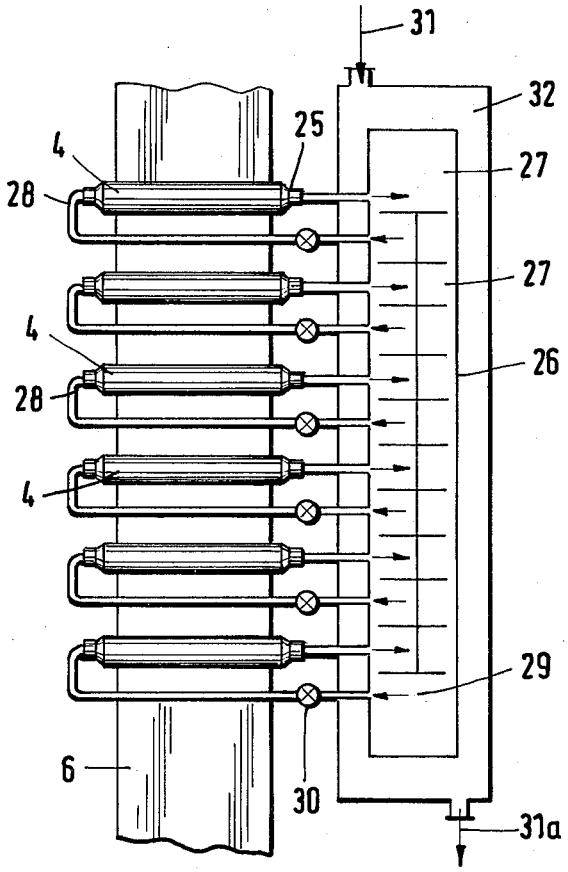
FIG. 2 is a partial front elevational view of a plurality of support rollers, designed according to the present invention, which rollers are connected to a cooling mechanism, according to the invention, to thereby form a support roller frame for the metallic cast strand.

According to the invention, the support rollers 4 are in fluid connection through their hollow journal pins 25, with a cooling device 26 (FIG. 2). Journal pins 25 drain the fluid from the rollers 4. The fluid connection is at the heat dissipating area 27 of the cooling device 26. The hollow journal pins 28 feed the cooling liquid into the rollers and are connected with a pump 30 in the low-temperature areas 29 of the cooling device 26. The cooling device 26, itself, is cooled by a process which operates countercurrent to the heat yielded by the cast strand 6 by means of the entering cooling conduit 31, which is part of a gaseous or, if applicable, liquid jacket 32, and the now heated cooling liquid leaving the cooling device 26 through exit conduit 31*a*. The cooling device 26 extends approximately parallel to the metallic cast strand 6 and is arranged next to, below or above the cast strand 6.

Figure 3:
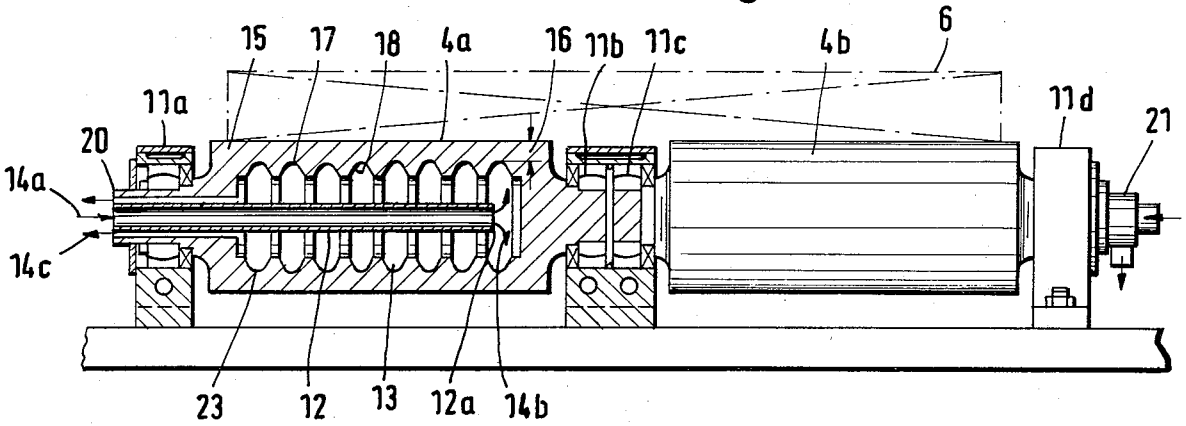
FIG. 3 shows a bifurcated support roller, according to the present invention; the left-hand side of the roller being shown in cross section.

The support rollers 4 (see FIG. 3) comprise separate support roller sections 4*a* and 4*b* having individual support bearings 11*a*, 11*b*, 11*c* and 11*d*.

The cooling apparatus, according to the invention, conveys cooling fluid 14, for example cooling water, in an open or closed cooling circuit into the central pipe 12 in the direction of arrow 14*a*, with the cooling fluid flowing out of the mouth 12*a* of pipe 12, in the direction of arrow 14*b*. From there the fluid is guided through the cooling zone 13. The fluid exits the support rollers 4 in the direction of the arrow 14*c*, after becoming heated up (as vapor or as a mixture of vapor and fluid). After leaving roller 4, the fluid passes through the cooling device 26, in order to be cooled off and reused.

In the illustrated exemplary embodiment, the structural roller element wall 15 is the interior wall of the support roller 4. In the area of the cooling zone 13, the thickness of the wall 16 (see FIG. 3) is steadily reduced from zone to zone. A zone 17 of this step-like structure does not represent a significant mechanical weakening of the remaining wall thickness 16.

Figure 5:
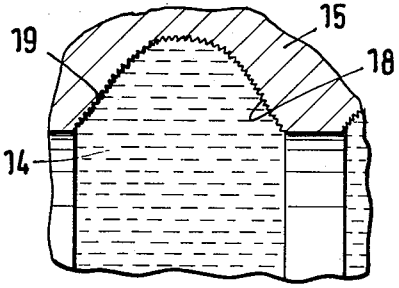
FIG. 5 is yet another enlarged cross sectional view of the support roller shown in FIG. 4.
Figure 4:
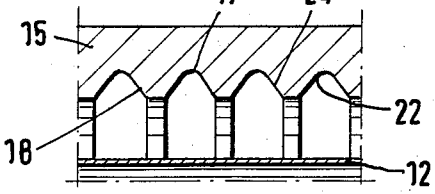
FIG. 4 is an enlarged cross sectional view of a support roller shown in FIG. 3.

The capacity of the support roller 4 to withstand stress is assured by the inner surface 18. Two features of the inner surface 18 facilitate heat transfer. More specifically, the inner shape of surface 18 is in the form of an archway and, therefore, enlarges the surface area of surface 18. Added to this is the fin-like structure 19 of inner surface 18, consisting of step-like recesses (best shown in FIG. 5), which is similar to the structure shown by heat transfer pipes, i.e., a large surface area is displayed to enhance heat flow.

A heat transfer pipe of this type is described in DE-AS 12 64 461. There, however, it is a closed structural element. Here, however, the support roller 4 may, in principle, have the exterior shape of such a heat transfer pipe.

The inner surface 18 is provided with recesses or steps 22, extending as a quasi wave-like pattern 24 in the longitudinal cross section 23. The quasi wave-like pattern 24 avoids the formation of stress peaks in the work material of the support rollers 4. The wavy-like pattern 24 may also be very long and drawn out or even flat, so that only one zone 17 is present along the length of the support roller sections 4*a* and 4*b*.

The high temperature of the metallic cast strand 6, which may be approximately 700° to 1,100° C., causes the cooling liquid 14 to heat up to its vaporizing point. It is, therefore, appropriate to eliminate the superheated steam because of the very high heat content within the cooling zone 13, and to substitute therefor cooler, unsaturated steam of the "fresh" cooling liquid and/or to continuously substitute a mixture of liquid and vaporous cooling liquid. The introduction of fresh coolant can be done in accord with the cooling curve of the slowly-solidifying metallic cast strand 6.

The teachings of the attached copy of the corresponding German application, upon which this application claims priority, is herein specifically incorporated by reference.

It should be understood, of course, that the specific form of the invention herein illustrated and described is intended to be representative only, as certain changes may be made therein without departing from the clear teachings of the disclosure. Accordingly, reference should be made to the following appended claims in determining the full scope of the invention.

I claim:

1. A method for cooling a continuously cast metallic strand, comprising:

(a) passing said metallic strand through a strand guide located downstream of a continuous casting mold;

(b) providing said strand guide with hollow structural roller elements, said roller elements being separated from one another in the range of about 3–5 mm.; and (c) exclusively cooling said continuously cast metallic strand and cooling said hollow structural roller elements by continuously passing a cooling fluid through the interior of said structural roller elements.

2. A method as claimed in claim 1, wherein:

(a) said hollow structural roller elements are only provided in the secondary cooling zone of said strand guide.

3. An apparatus for cooling a continuously cast metallic strand, comprising:

(a) a strand guide located downstream of a continuous casting mold;

(b) said strand guide having a plurality of hollow structural roller elements;

(c) said structural roller elements being separated from one another in the range of about 3–5 mm.; and (d) said roller elements having cooling fluid continuously pass through its interior for exclusively cooling said continuously cast metallic strand and for cooling said roller elements.

4. An apparatus as claimed in claim 3, wherein:

(a) said hollow structural roller elements are located at the secondary cooling zone of said strand guide.

5. An apparatus as claimed in claim 3, wherein:

(a) the interior wall of said hollow roller elements is wave-like.

6. An apparatus as claimed in claim 3, wherein:

(a) the interior wall of said hollow roller elements is comprised of a series of arches.

7. An apparatus as claimed in claim 6, wherein:

(a) said arches define step-like recesses.

8. An apparatus as claimed in claim 7, wherein:

(a) said recesses have a width and depth of less than 1 mm.

9. An apparatus as claimed in claim 3, wherein:

(a) said hollow structural roller elements are supported by hollow bearing pins; and (b) said hollow bearing pins are connected to an inflow conduit and an outflow conduit for said cooling fluid.

* * * * *